US006183429B1

(12) United States Patent
Dervieux

(10) Patent No.: US 6,183,429 B1
(45) Date of Patent: Feb. 6, 2001

(54) ABDOMINAL MASSAGE AND/OR STIMULATION DEVICE

(76) Inventor: Dominique Dervieux, "Le Panoramer" 31 corniche André de Joly, 06300 Nice (FR)

( * ) Notice: Under 35 U.S.C. 154(b), the term of this patent shall be extended for 0 days.

(21) Appl. No.: 08/714,062

(22) PCT Filed: Jan. 11, 1995

(86) PCT No.: PCT/FR95/00031

§ 371 Date: Nov. 10, 1997

§ 102(e) Date: Nov. 10, 1997

(87) PCT Pub. No.: WO95/19159

PCT Pub. Date: Jul. 20, 1995

(30) Foreign Application Priority Data

Jan. 13, 1994 (FR) ..... 94 00504

(51) Int. Cl.[7] ..... A61H 15/00
(52) U.S. Cl. ..... 601/87; 601/112; 601/134
(58) Field of Search ..... 601/85, 87, 93–95, 601/103, 104, 112–114, 134–138, 44, 79, 81

(56) References Cited

U.S. PATENT DOCUMENTS

| | | | | |
|---|---|---|---|---|
| 1,577,751 | * | 3/1926 | Paschall | 601/112 |
| 2,853,998 | * | 9/1958 | Emerson | 601/44 |
| 4,414,963 | * | 11/1983 | Kunz | 601/134 |
| 5,305,738 | * | 4/1994 | Shimizu | 601/135 X |
| 5,685,827 | * | 11/1997 | Shimizu | 601/87 |
| 5,797,859 | * | 8/1998 | Prehodka | 601/87 X |

FOREIGN PATENT DOCUMENTS

| | | | |
|---|---|---|---|
| 313679 | | 4/1956 | (CH) . |
| 671333 | * | 8/1989 | (CH) ..... 601/113 |
| 62986 | | 8/1933 | (DE) . |
| 9301028 | | 11/1993 | (DE) . |
| 1460857 | | 2/1966 | (FR) . |

* cited by examiner

*Primary Examiner*—Danton D. DeMille
(74) *Attorney, Agent, or Firm*—James C. Lydon

(57) ABSTRACT

An abdominal massaging device includes a support and a first plate rotatably mounted on the support. At least one projection extends from and is rotatably mounted upon the first plate. In this way, the projection is effective to rotate with respect to the surface of the plate. In an alternative embodiment a plurality of second plates are disposed on the first plate and projections are disposed on the second plates. The supports for the device further include concave portions for receiving a user's pelvis and rib cage.

11 Claims, 4 Drawing Sheets

ABDOMINAL MASSAGE AND/OR STIMULATION DEVICE

BACKGROUND OF THE INVENTION

The present invention relates to a abdominal massage and/or stimulation device, for the promotion of the intestinal and biliary evacuation.

Among the known devices for massaging the human body, one can cite in particular that described in the document FR-A-2606632. This device comprises a massage head composed of a flat supporting plate having a plurality of projections of spherical envelope. The head is trained to follow an orbital periodical movement around an axis that is perpendicular to the median plane of the supporting plate.

This device, as well as the other known devices, having projections or relieves, are especially used for eliminating cellulite or for applying relaxing muscular massages, or for applying an ointment.

But there is no specific massaging device that helps the digestive functions, for example the progression of the alimentary bolus in order to fight against constipation or other troubles linked to digestive laziness. Similarly, no massaging device is known, that helps the evacuation of the bile, in order to fight against biliary sluggishness.

OBJECTS AND SUMMARY OF THE INVENTION

One of the objects of the present invention is to provide a device for the abdominal massage and/or stimulation permitting the realisation of the aforementioned functions.

This object, as well as others that will become apparent later, are achieved by a device for the abdominal massage and/or stimulation that is, according to the present invention, characterised by the fact that it comprises massaging projections trained in rotation and/or according to relatively slow linear movements by a motor and are arranged on top of a support comprising this motor along with some props for the bony portions of the patient—the pelvis and the rib cage.

According to the first embodiment, every massaging projection is driven in a rotational movement around itself, and eventually combines to a rotation around another axis forming a sharp angle with its axis of rotation.

According to a second embodiment, the massaging projections are arranged on a plate driven in rotation by a motor. This rotating plate may be driven in a non-plane rotating motion around an axis which forms an angle with the rotation axis.

Preferably, the support has the shape of parallelepiped with the perimeter of its upper projection. In this way the bony portions of the pelvis and the rib cage of a patient will be in contact with the support, while the massaging projections will penetrate sufficiently deep in the abdominal wall in order to act on the hollow organs.

As far as the other supports are concerned, they can be flat and the massaging projections protruding outwardly therefrom. The support will be preferably chosen convex, in order to relax the abdominal muscles, and the massaging projections will be located at the top of the convexity.

Advantageously, when the massaging projections are arranged on the rotating plate trained in rotation by a motor, the lower face of this plate comprises a rolling or a sliding system or surface on an identical surface, located on the support.

According to a second example of this embodiment, the device comprises a rotating plate on which are disposed secondary rotating plates equipped with massaging projections.

Advantageously, the massaging projections are spherical, ovoidal, in the shape of digits which are relatively big and long, in progressive inclination, symmetrical (or not) one to the other, adjustable, interchangeable, fixed or with linear, rotating or in a rocking motion, coming in and out alternatively, all these movements could eventually be dissociated or combined, mechanically or programmed.

Preferably, the motor unit drives the rotating plate or the first rotating plate by means of an horizontal or vertical gear.

Favourably, in this second embodiment, the motor additionally comprises a fixed plate, located under the first rotating plate, having a smaller diameter than the first rotating plate, with the same axis and a toothed edge, in order to train the axis of the secondary plates.

In case the projections move on the abdomen, a soft protective cloth preferably covers the massaging projections and is maintained in position on the support, so that the abdomen skin is not drawn along.

BRIEF DESCRIPTION OF THE DRAWINGS

The following description that has no restrictive character, must be read with reference to annexed figures, amongst which.

Figure 1:
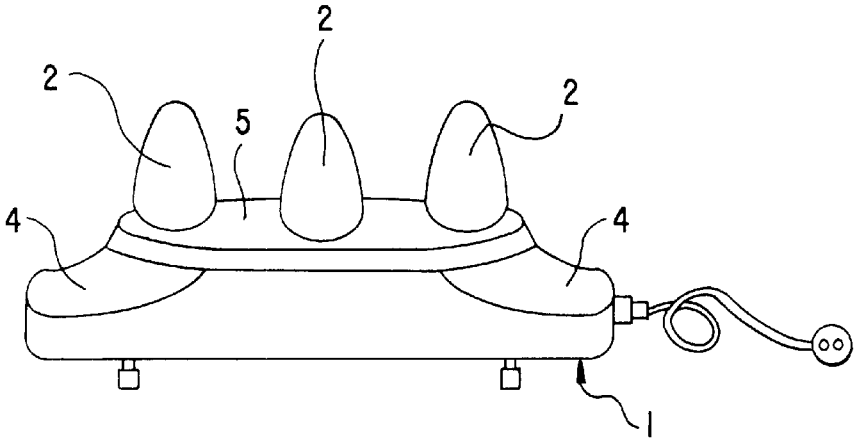
FIG. 1 represents a side view of a device for the abdominal massage and stimulation according to a first embodiment.

As we can see it from these figures, an abdominal massage and/or stimulation device comprises a support referred to with reference 1, and at least one massaging projection 2 trained in circular and/or linear movement by a motor 3 located in the support 1.

Support 1 can be of various shapes and dimensions. It can, for example, be constituted of a planar massaging table comprising an elevation on which are disposed the massaging projections. This table can also be concave on its transversal plane: the massaging projections will then be located on top of the concavity. But, in both cases, the table area composing the support 1 provided with its projections, corresponds to the patients abdomen 6 where his bony portions, that is the rib cage 7*a* and the superior front hip-bones 7*b*, should be in contact with the table itself. This will permit sufficient penetration of the massaging projections 2 in the abdomen 6 in such a manner that they can act especially on the large intestine and the coledochus duct.

But, support 1 can also be of an approximately parallelepipedic form as represented in the figures. In this case, the perimeter of its face, provided with the massaging projections 2, or upper face 4, will be such that the bony portions, that is the rib cage 7*a* and the superior front hip-bones, will be able to lean on support 1, whilst the massaging projections 2 will penetrate in the abdominal wall 6, as they are arranged on this face 4 in a prominent way.

Figure 2:
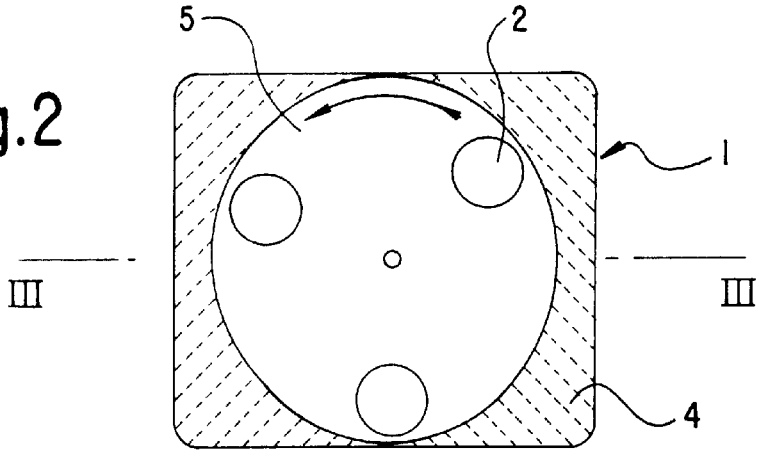
FIG. 2 is a top view of the device according to FIG. 1.
Figure 3:
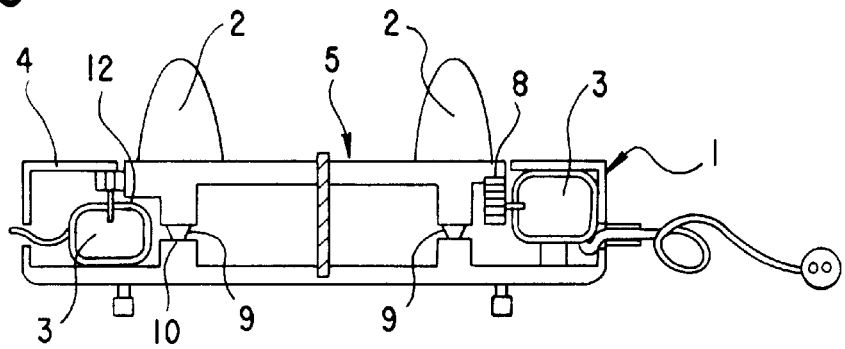
FIG. 3 is a schematic vertical cross-section of the device along line III—III of FIG. 2, FIG. 4 schematically represents the position of the device on a human abdomen.
Figure 4:
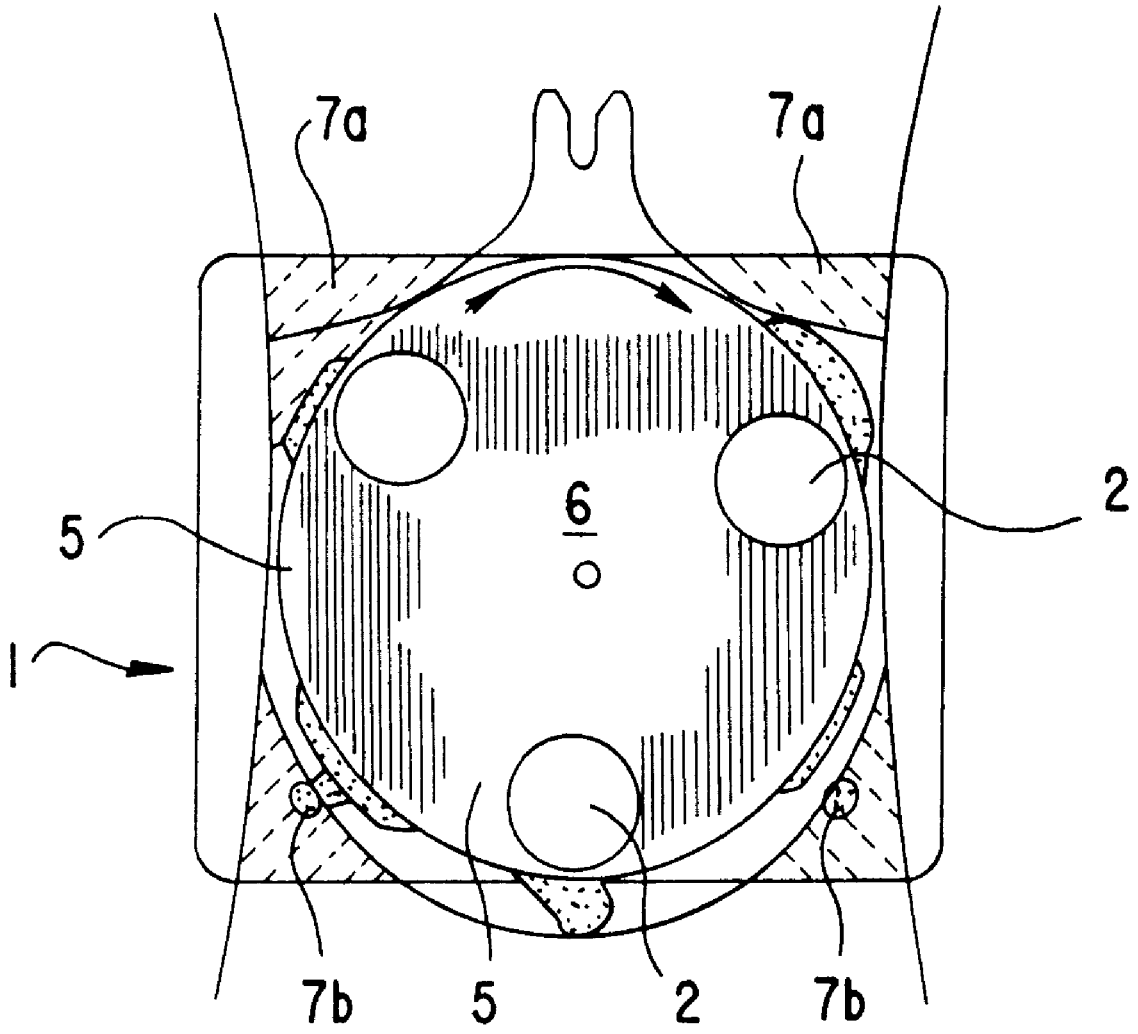

According to the first embodiment shown in FIGS. 1 to 3, the massaging projections 2 are arranged on a rotating plate 5. Bottom face 8 of this plate comprises a system or a rolling and sliding surface 9 rolling or sliding on an identical surface 10 located in support 1 or motor block, which is in these examples of a parallelepipedic shape.

In this embodiment, the plate 5 is trained in rotation with an electrical motor 3 operating either vertically or horizontally (both possibilities are shown on the same FIG. 3): in the first case, the side face 12 of the rotating plate 5 is toothed; in the second case, the bottom face 8 of this rotating plate 5 comprises a crown wheel.

The direction of rotation of the rotating plate 5, as one might expect, is inverse to the peristaltic direction of the colon, that is counter-clockwise.

The massaging projections 2 are of any convenient form: spherical, ovoidal, in shape of digits, which are relatively big and long, in progressive inclination, symmetrical or asymmetrically disposed one to the other, adjustable, interchangeable, fixed or with linear, rotating or in rocking motion, coming in and out alternatively, all could eventually be combined. But the massaging projections 2 should be able to perform sufficiently slow, large and/or spaced movements in order to permit a deep massage of the abdomen.

Figure 5:
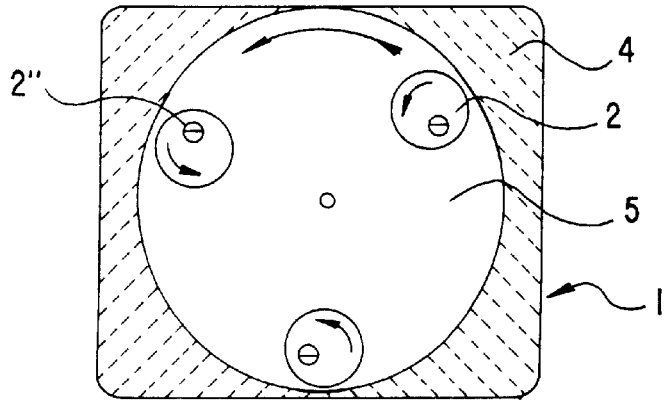
FIG. 5 is a schematic top view of a device according to an alternative of the first embodiment.

According to an alternative of this first embodiment shown on FIG. 5, the massaging projections 2 are themselves rotating on the rotating plate 5. The rotating direction of these massaging projections 2 is the one of the rotating plate 5, on which they are set in a known way. The massaging projections 2 are non-symmetrically shaped, their blunt tope being disposed out of true center, as is shown in 2".

Figure 6:
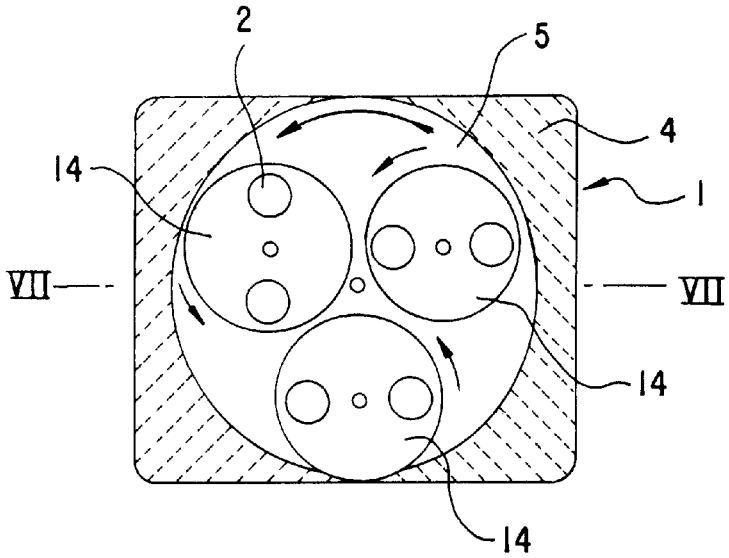
FIG. 6 is a top view of the device according to the first embodiment.
Figure 7:
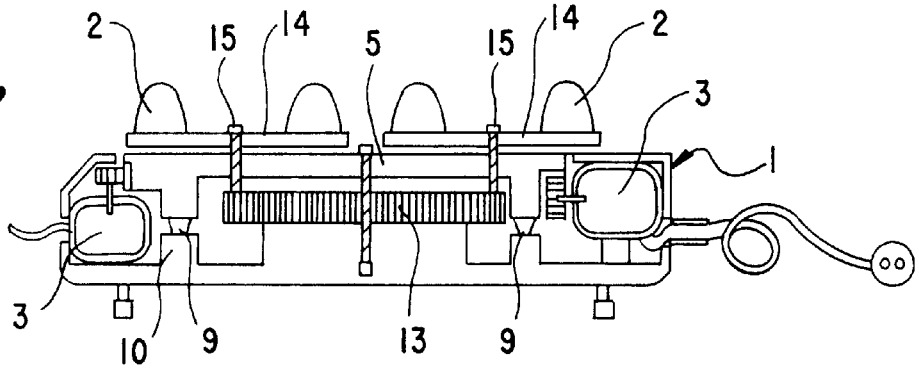
FIG. 7 is a schematic vertical cross-section along line VII—VII of FIG. 6.

FIGS. 6 and 7 relate to a second embodiment of the abdominal massage and/or stimulation device, according to the present invention. The elements which are identical or similar to the ones described in reference to the first embodiment have the same reference.

Support 1 or the motor block additionally comprises a fixed plate 13 having the same axis as the rotating plate 5, with a toothed edge, its diameter being smaller than the one of the surface for rolling or sliding.

In this example, on top of the rotating plate 5, or main rotating plate, three secondary plates 14 are arranged, each including two massaging projections 2. The rotation axis 15 of these secondary plates 14 engage on the toothed edge of the fixed plate 13.

It is clear that the rotation of the main plate 5 causes the rotation of the secondary plates 14 because of the movement of their rotation axis 15 on the toothed edge of the fixed plate 13.

Figure 8:
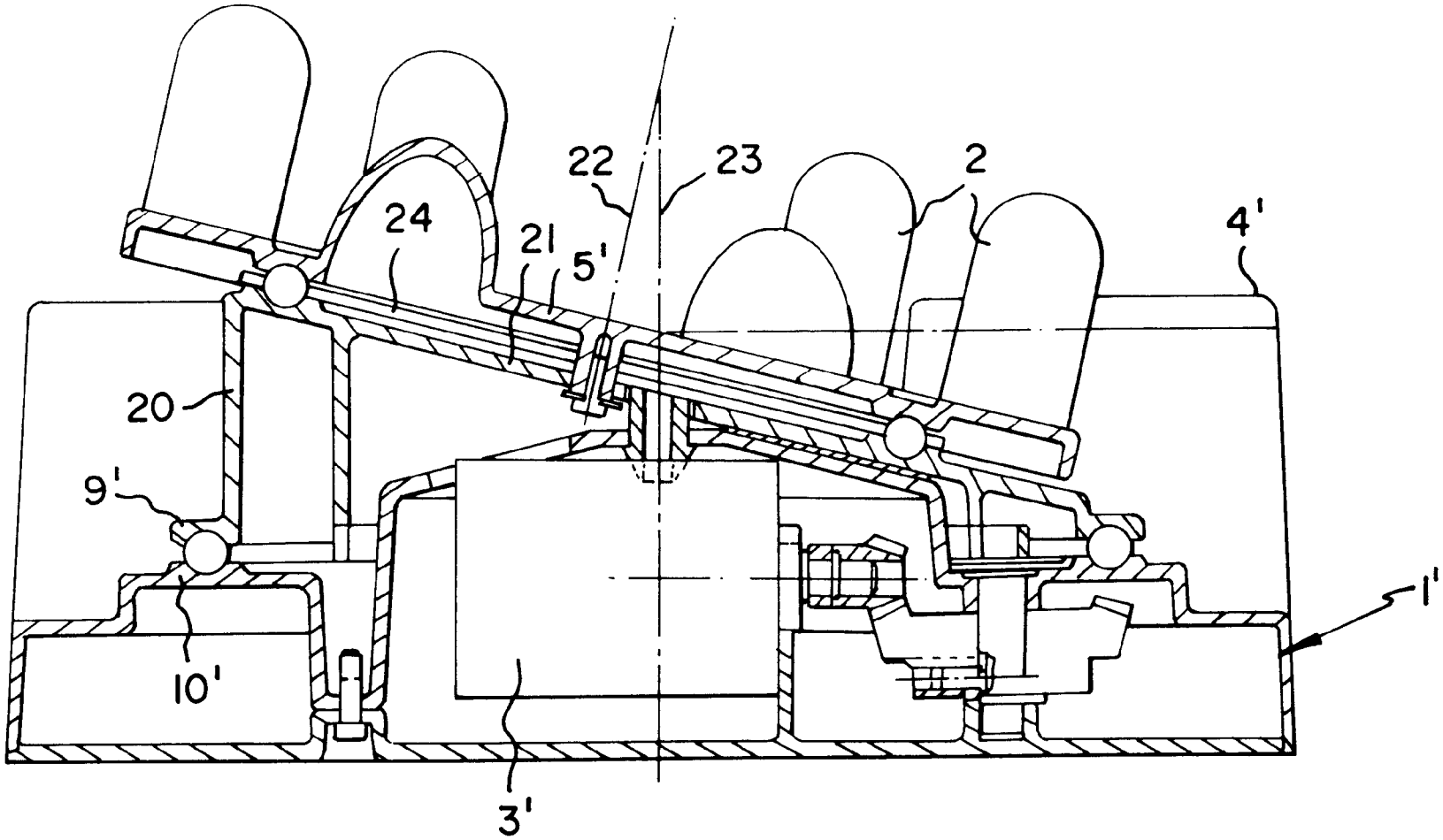
FIG. 8 represents a vertical cross-section of a third embodiment of the device according to the present invention.

According to a third embodiment of the present invention shown on FIG. 8, the device comprises an intermediate plate 20 that is trained in rotation by a motor 3' and has an inclined superior surface 21.

On this inclined superior surface 21, is mounted the rotating plate 5'. The axis of rotation 22 of that later being perpendicular to superior surface 21 is a small distance away from the axis of rotation 23 of the intermediate plate 20. The rotating plate 5 comprises massaging projections 2'.

When the intermediate plate 20 rotates, the axis of rotation 22 of the rotating plate 5', forms a cone around the axis of rotation 23 of the intermediate plate 20 which results in a rocking motion for the rotating plate 5', that is translated to a linear movement of every projection 2' with respect to abdomen 6.

According to an alternative of this embodiment, the rotating plate 5' is supported by an intermediate sliding means, such as a second plate 24 which turns freely between the superior inclined surface 21 and the principal plate 5. In this way, when one either mechanically retains or leans on principal plate 5', it remains stationary while allowing the massaging projections 2' to act.

As said, the massaging projections can be trained in linear movements one after the other. Each one acts by pressure release, according to repetitive come-and-go movements in the vertical plane.

In other possible embodiment, the massaging projections can move in a linear direction, with horizontal translation.

What is claimed is:

1. A massager for massaging a body part of a user, said massager comprising:

a first plate tilted obliquely with respect to and rotatable about a first axis;

a second plate overlying said first plate and rotatable about a second axis passing through said first and second plates, said second plate including at least one massaging element thereon;

said first axis and said second axis are oblique to one another so that when one of said first and second plates rotates with respect to the other, said second plate undergoes a rocking motion about said first axis.

2. The massager as claimed in claim 1, wherein said massaging element is at least one of a spherical projection, and an ovoidal projection.

3. The massager as claimed in claim 1, wherein said first and second axes are arranged so that said massaging element undergoes translational movement when said second plate undergoes said rocking motion.

4. The massager as claimed in claim 1, further comprising a rotary bearing disposed between said first and second plate.

5. The massager as claimed in claim 1, further comprising a motor coupled to said first plate and effective to rotate said first plate about said first axis.

6. The massager as claimed in claim 1, further comprising a support, said support coupled to and tilting said first plate with respect to said first axis, said support further being rotatable about said first axis.

7. The massager as claimed in claim 6, further comprising a motor coupled to said support and effective to rotate said support and said first plate about said first axis.

8. The massager as claimed in claim 7, wherein said first and second axes are arranged so that said massaging element undergoes translational movement when said second plate undergoes said rocking motion.

9. The massager as claimed in claim 8, further comprising a rotary bearing disposed between said first and second plate.

10. The massager as claimed in claim 8, wherein said second plate is adapted to not rotate when said massaging element is massaging while said first plate rotates with respect to said second plate.

11. A massager for massaging a body part of a user, the massager comprising:

a support, a first axis on the support, a first plate tilted obliquely with respect to and rotatable about the first axis; and a motor for driving the first plate to rotate about the first axis, a second plate overlying the first plate, the second plate being rotatable about a second axis passing through the first and second plates;

the second plate including at least one massaging element thereon;

the first axis and the second axis are oblique to one another, such that rotation of the first plate by the motor causes the second plate to have a rocking motion with respect to the support and that rocking motion is converted to translatory movement of the at least one massaging element on the second plate.

* * * * *